United States Patent [19]

Suga

[11] Patent Number: 5,056,479

[45] Date of Patent: Oct. 15, 1991

[54] VALVE TIMING CONTROL DEVICE FOR INTERNAL COMBUSTION ENGINE

[75] Inventor: Seiji Suga, Kanagawa, Japan

[73] Assignee: Atsugi Unidia Corporation, Kanagawa, Japan

[21] Appl. No.: 619,732

[22] Filed: Nov. 29, 1990

[30] Foreign Application Priority Data

Nov. 30, 1989 [JP] Japan ..... 1-312094

[51] Int. Cl.[5] ..... F01L 1/34

[52] U.S. Cl. ..... 123/90.17; 123/90.31; 123/420; 123/501; 464/77

[58] Field of Search ..... 123/90.17, 90.31, 420, 123/501, 502; 464/77

[56] References Cited

U.S. PATENT DOCUMENTS 3,262,435 7/1966 Cribbs ..... 123/90.31
3,482,559 12/1969 Salomon ..... 123/420
4,359,985 11/1982 Mueller ..... 464/77
4,509,490 4/1985 Morin ..... 123/501
4,841,924 6/1989 Hampton et al. ..... 123/90.17

FOREIGN PATENT DOCUMENTS 3638527 5/1988 Fed. Rep. of Germany ... 123/90.17
1193283 11/1985 U.S.S.R. ..... 123/501

*Primary Examiner*—Willis R. Wolfe
*Assistant Examiner*—Weilun Lo
*Attorney, Agent, or Firm*—Bachman & Lapointe

[57] ABSTRACT

A valve timing control device includes a pair of clutches designed for restricting relative phase shift between an engine revolution synchronous rotary member and a camshaft. One of the pair of clutches restricts phase shift between the rotary member and the camshaft in valve timing advancing direction, and the other restricts relative phase shift between the rotary member and the camshaft in valve timing retarding direction. The pair of clutches are associated with a hydraulic means which is responsive to the engine driving condition and selectively make active one of the clutches.

5 Claims, 4 Drawing Sheets

VALVE TIMING CONTROL DEVICE FOR INTERNAL COMBUSTION ENGINE

BACKGROUND OF THE INVENTION

1. Field of the Invention

The present invention relates generally to a valve timing control system for an internal combustion engine, for adjusting open and close timing of intake and/or exhaust valves depending upon engine driving condition. More specifically, the invention relates to a valve timing control device for an internal combustion engine which has a pair of clutch for selectively restricting phase shift of a camshaft relative to engine revolution in phase advancing and retarding direction.

2. Description of the Background Art

In the modern automotive technologies, it is important to achieve both of high driving performance and fuel economy. High engine performance is especially important at high engine load range. On the other hand, at low engine load range, fuel economy will be regarded as more important factor than the engine performance. Furthermore, in the recent days, anti-polution is becoming more important factor for avoiding contamination of atmosphere. Fuel consumption and purity of exhaust gas can be adjusted by adjusting induction efficiency of an air/fuel mixture into engine combustion chambers. For adjusting mixture gas induction efficiency, some of advanced automotive internal combustion engines employ variable cam timing technologies for advancing and retarding valve open timing with respect to top-dead-center (TDC) in the engine revolution cycle.

For example, the U.S. Pat. No. 4,535,731, issued on to, and assigned to the common owner to the present invention, proposes a valve timing control device for an internal combustion engine. The device adjusts open timing of an intake valve and/or exhaust valve of an internal combustion engine. The device includes a helical intermediate gear formed with an external helical gear teeth meshing with an internal gear teeth of an engine revolution synchronous component, such as a timing sprocket or timing pulley, and an internal gear teeth meshing with an external gear teeth of an internal gear which is rigidly connected to a camshaft. The intermediate gear is axially movable for varying rotational phase relationship between the engine revolution synchronous component and the internal gear. The axial position of the intermediate gear is adjusted hydraulically depending upon an engine driving condition so that open timing of the intake valve and/or the exhaust valve is advanced or retarded with respect to engine revolution cycle.

Such prior proposed valve timing control device is successfully in effectively adjusting valve timing. However, on the other hand, such prior proposed valve timing control device employs the helical gear teeth for adjusting the phase relationship between the rotational input torque and rotational cam drive torque. For holding accuracy in engagement between gears, it is required substantially high accuracy in production. Therefore, machining of the gears becomes difficult and costful. Furthermore, during long use, wearing and secular variation may loose tight engagement between the gears for causing variation of the valve timing out of an optimal range.

Furthermore, since the prior proposed device is required to drive the helical intermediate gear meshing with the timing sprocket or timing pulley, and the inner gear, relatively great hydraulic and/or mechanical force is required. For reliably accepting relatively large operational force, the whole assembly of the valve timing control device necessarily becomes bulky to increase engine weight.

SUMMARY OF THE INVENTION

Therefore, it is an object of the present invention to provide a valve timing control device for an internal combustion engine which can solve the problems or drawbacks in the prior art.

Another object of the invention is to provide a valve timing control device which can reduce requirement for accuracy in machining components with holding equivalent valve timing control performance.

In order to accomplish aforementioned and other objects, a valve timing control device, according to the present invention, includes a pair of clutches designed for restricting relative phase shift between an engine revolution synchronous rotary member and camshaft. One of the pair of clutches restricts phase shift between the rotary member and the camshaft in valve timing advancing direction, and the other restricts relative phase shift between the rotary member and the camshaft in valve timing retarding direction. The pair of clutches are associated with a hydraulic means which is responsive to the engine driving condition and selectively make active one of the clutches.

According to one aspect of the invention, a valve timing control device for an internal combustion engine, comprises:

an engine revolution synchronous rotary member which is drivingly connected to the internal combustion engine to be driven for rotation in synchronism with the engine revolution;

a camshaft associated with at least one of an intake and exhaust valves of an engine cylinder for driving associated intake and exhaust valves;

a camshaft synchronous rotary member connected to the camshaft for rotation in synchronism with rotation of the camshaft, the camshaft synchronous rotary member being coupled with the engine revolution synchronous rotary member to be rotatingly driven by rotational torque transmitted through the engine revolution synchronous rotary member with maintaining given rotational phase relationship to the latter;

a first and second spring clutch assemblies which are selectively engaged and disengaged for selectively permitting relative phase shift between the engine revolution synchronous rotary member and the camshaft synchronous rotary member in timing advancing and retarding timing in order to set the given rotational phase relationship.

In the preferred construction, each of aid first and second clutch assemblies comprises a spring clutch having first end connected to the engine revolution synchronous rotary member. The spring clutches in the first and second clutches may have winding directions mutually opposite to each other. Also, the spring clutch may have a second end connected to a rotary cylinder which is associated with stopper means selectively restricting and permitting rotation of the spring clutch for engaging and disengaging associated spring clutch. In such case, the stopper means may comprise a plunger housed within a plunger bore extending within the engine revolution synchronous rotary member, the plunger being operable between a first position restricting rotation of the rotary cylinder and a second position permitting rotation of the rotary cylinder.

BRIEF DESCRIPTION OF THE PREFERRED EMBODIMENT

The present invention will be understood more fully from the detailed description given herebelow and from the accompanying drawings of the preferred embodiment of the invention, which, however, should not be taken to limit the invention to the shown embodiment but are for explanation and understanding only.

DESCRIPTION OF THE PREFERRED EMBODIMENT

Figure 1:
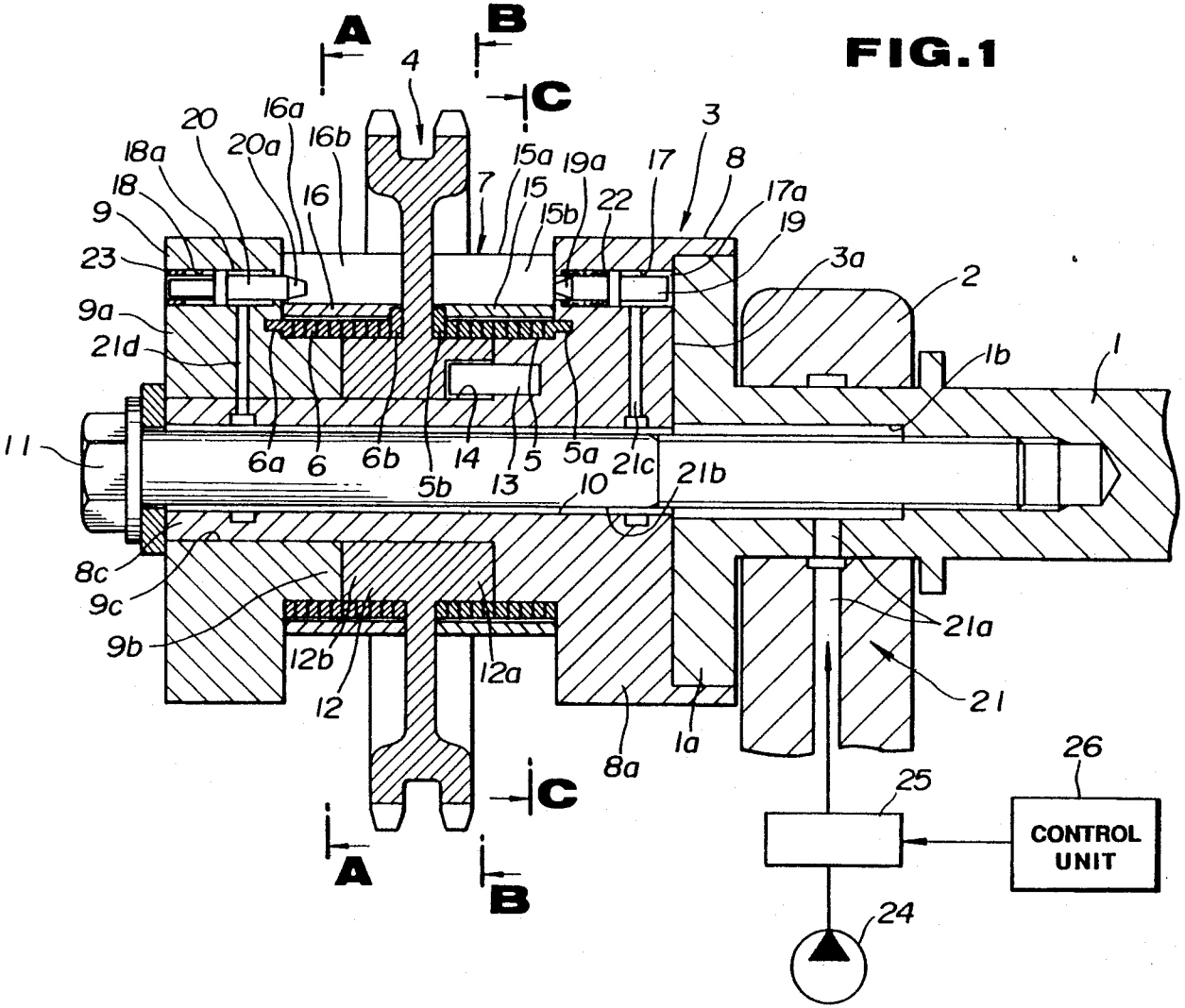
FIG. 1 is a cross section of the preferred embodiment of a valve timing control device, according to the present invention.

Referring now to the drawings, particularly to FIG. 1, the preferred embodiment of a valve timing control device, according to the present invention, is associated with an internal combustion engine for controlling open and close timing of an intake and/or exhaust valves. A camshaft 1 is rotatably supported on a cam bearing 2 at the upper portion of a cylinder head. In the shown embodiment, the camshaft 1 is associated with an intake valve for controlling induction timing of an air/fuel mixture into an engine combustion chamber. The camshaft 1 carries a rotary support 3 at one end for rotation therewith. The rotary support 3 rotatably supports a timing sprocket 4 which is drivingly connected to a driving sprocket which is fixed to a crankshaft, via a timing chain. As can be appreciated, the timing sprocket 4 thus driven in synchronism with engine revolution. First and second spring clutches 5 and 6 are provided for restricting relative angular displacement between the timing sprocket 4 and the rotary support 3 in valve timing advancing and retarding directions, selectively. The first and second spring clutches 5 and 6 are associated with a switching mechanism 7 which selectively engage and disengage the first and second spring clutches.

The rotary support 3 is formed with a circular recess 3*a* to receive a flange section 1*a* of the camshaft 1. The rotary support 3 comprises a main body 3 having a greater diameter section 8*a* and a smaller diameter section 8*b*, and a ring member 9 having greater diameter section 9*a* and a smaller diameter section 9*b*. The main body 8 further have a hollow shaft section 8*c*. The ring member 9 is formed with a center opening 9*c* having a diameter substantially equal to the external diameter of the hollow shaft section 8*c* of the main body. The smaller diameter section 8*b* of the main body 8 is thus received in the center opening 9*c* of the ring member 9. Greater diameter sections 8*a* and 9*a* are oriented at both axial ends of the rotary member 3 to serve as end flanges, and thus defines a sprocket receptacle annular groove therebetween together with the smaller diameter sections 8*b* and 9*b*. The timing sprocket 4 has an annular base portion 12. The height of the annular base portion 12 of the timing sprocket 4 is set so that the outer circumference lies in flush with the outer circumferences of the smaller diameter sections 8*b* and 9*b* of the main body 8 and the ring member 9. The annular base portion 12 has axial end sections 12*a* and 12*b* having axial end faces slidingly mating with the end surfaces of respectively corresponding smaller diameter sections 8*b* and 9*b*.

Figure 3:
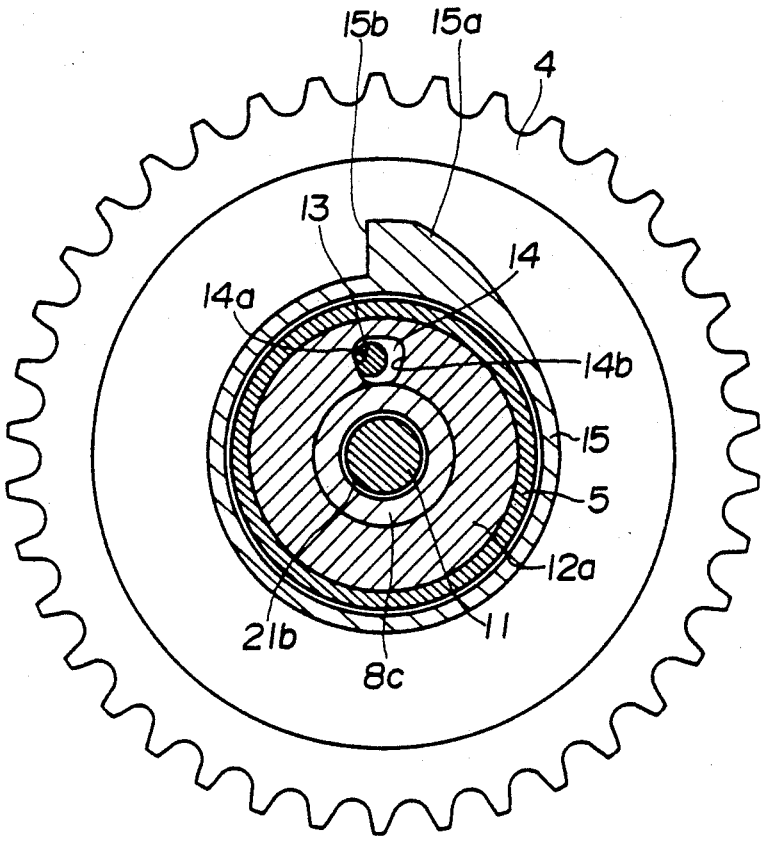
FIG. 3 is a section taken along line A—A in FIG. 1.

A stopper pin 13 is extended from the axial end of the smaller diameter section 8*b* for restricting relative angular displacement between the timing sprocket 4 and the rotary support 3. The stopper pin 13 is thus engaged with a circumferentially enlongated opening 14 (as best shown in FIG. 3). As can be seen from FIG. 3, the range of relative angular diplacement between the timing sprocket 4 and the rotary support 3 is defined by the circumferential length of the elongated opening 14. Therefore, both radially extending edges 14*a* and 14*b* of the enlongated opening 14 are cooperative to prevent overrunning of relative angular displacement.

The spring clutches 5 and 6 are wound on the outer circumference of the smaller diameter sections 8*b* and 9*b*. Winding directions of the spring clutches 5 and 6 are mutually opposite to each other. Each of the spring clutches 5 and 6 have ends 5*a* and 6*a* firmly engaged to the greater diameter sections 8*a* and 9*a* of the main body 8 and the ring member 9. The other ends 5*b* and 6*b* of the spring clutches 5 and 6 are secured onto cylindrical members of the switching mechanism 7.

Figure 2:
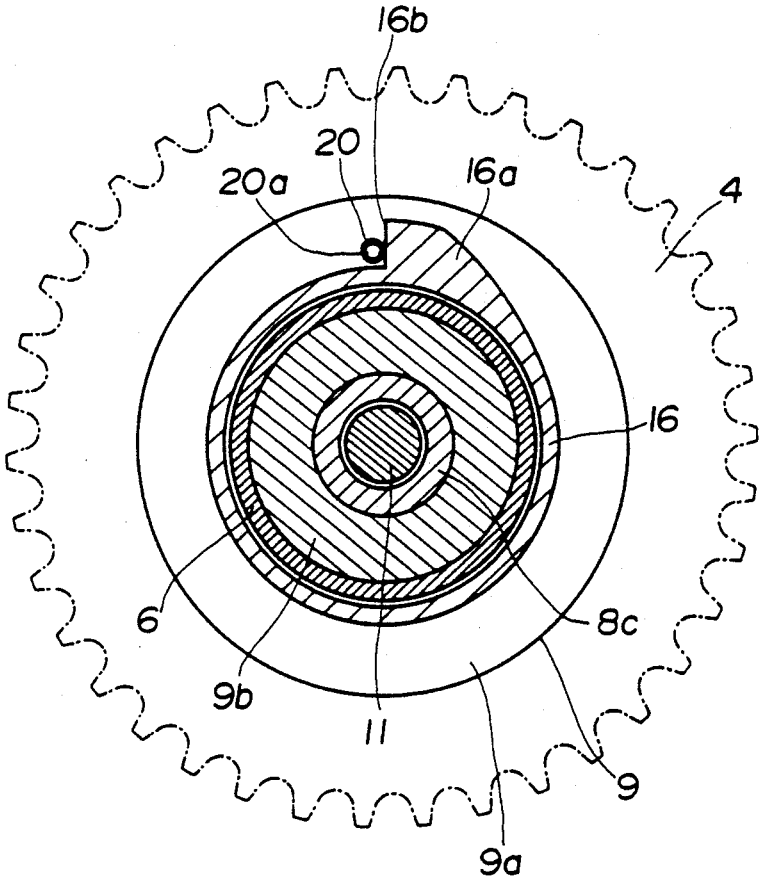
FIG. 2 is a section taken along line A—A in FIG. 1.
Figure 4:
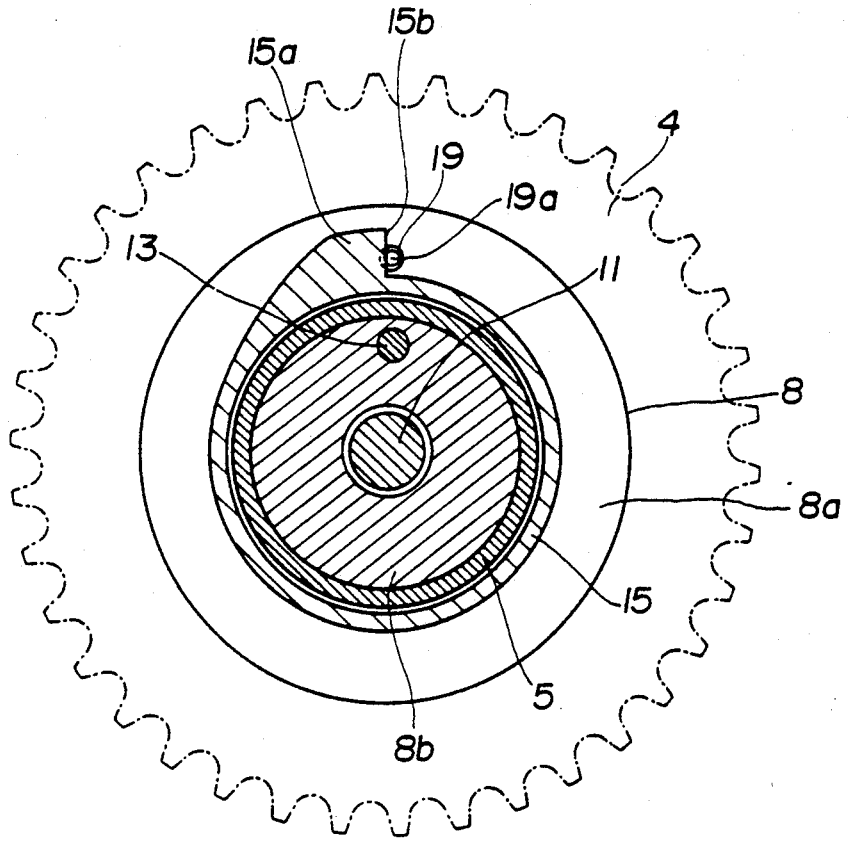
FIG. 4 is a section taken along line A—A in FIG. 1.

As shown in FIGS. 2, 3 and 4, the switching mechanism 7 includes first and second cylindrical members 15 and 16 respectively disposed between the greater diameter sections 8*a* and 9*a* of the main body 8 and the ring member 9 and the timing sprocket 4. The first and second cylindrical members 15 and 16 receives the other ends of the spring clutches 5 and 6. The switching mechanism 7 also includes a pair of hydraulic cylinders 17 and 18 with first and second plunger 19 and 20 which are movable in axial direction. The plungers 19 and 20 are axially driven by hydraulic pressure supplied through hydraulic circuit which is generally represented by the reference numeral 21.

As seen from FIGS. 2 and 4, respective of the cylindrical members 15 and 16 are formed with bulged section 15*a* and 16*a* with stopper edges 15*b* and 16*b* which extend substantially in radial direction. The stopper edges [E] 15*b* and 16*b* are cooperative with the first and second plungers 19 and 20. The first and second plungers 19 and 20 have generally conical plunger heads 19*a* and 20*a*. The plunger heads 19*a* and 20*a* opposes the radially extending stopper edges 15*a* and 16*a* of the cylindrical members 15 AND 16. The plungers 19 and 20 are normally biased toward the inside of the associated one of the cylinders 17 and 18 by means of first and second return springs 22 and 23. Between the rear end portions of the plungers 19 and 20 and the inner periphery of the cylinders 17 and 18, pressure chambers 17*a* and 18*a* are defined. Pressurized hydraulic fluid is introduced into these pressure chambers 17*a* and 18*a* for driving the plungers 19 and 20 toward and away from the cylinders.

The fluid circuit includes a fluid pump 24 and an electromagnetic valve 25 which is associated with a controller 26 so that it may be selectively placed at preselected valve positions depending upon the engine driving condition. The hydraulic circuit 21 further includes an introduction path 21*a* extending through the cam bearing 2 and the cam bearing 2. The induction path 22 is communicated with an axially extending annular path 21*b* which is defined between an external periphery of fastening bolt 11 and the inner periphery of the rotary support 3. The annular path 21*b* is in fluid communication with radial paths 21*c* and 21*d* which are defined through the greater diameter sections 8*a* and 9*a* of the main body 8 and the ring member 9. As can be seen, the pressure chambers 17*a* and 18*a* are defined to exert hydraulic pressure for the plungers 19 and 20 in opposite directions to each other. Namely, when high pressure is supplied to the pressure chambers 17*a* and 18*a*, the plunger 19 is protruded from the cylinder 17 to restrict rotation of the first cylindrical member 15 in clockwise direction of FIG. 4. At the same time, the plunger 20 is retracted into the cylinder 18 to permit rotation of the cylindrical member 16. On the other hand, when the high pressure is terminated, the plunger 20 is protruded by the spring force of the spring 23 from the cylinder 18 to restrict counterclockwise rotation of the cylindrical member 16. On the other hand, at the same time, the spring 22 is active on the plunger 19 to retract into the cylinder 17. As a result, the cylindrical member 15 is permitted to rotate.

It should be appreciated that the supply and drain for the pressure chambers 17*a* and 18*a* of the pressurized fluid from the oil pump 24 is controlled by the valve position of the electromagnetic valve. The control unit 26 monitors the engine driving condition to feed control signal for the electromagnetic valve 25 to control the valve position. In general, the valve timing is advanced at relatively high engine load condition and is retarded or maintained to an initial position at relatively low engine load condition. Therefore, the control unit 26 monitors engine load condition to derive the valve control signal. For example, the control unit monitors an engine speed represented by a crank angle signal, e.g. crank reference signal or crank position signal, from a crank angle sensor (not shown) and an intake air flow rate from an air flow meter (not shown).

In the shown embodiment, while the engine load is maintained lower than a predetermined engine load criterion, the control signal to be supplied from the control unit 26 to the electromagnetic valve 25 is maintained at LOW level to maintain the electromagnetic valve in an initial position. At this valve position, fluid flow from the oil pump 24 to the pressure chambers 17*a* and 18*a* is blocked. Therefore, pressurized fluid is not supplied to the pressure chambers 17*a* and 18*a*. As set forth, in such case, the plunger 20 is protruded to restrict counterclockwise rotation of the cylindrical member 16 and the plunger 19 is placed at the retracted position to permit rotation of the cylindrical member 15. At this condition, the first spring clutch 5 couples the smaller diameter section 18*a* and the axial end portion 12*a* via its resilient force to restrict relative displacement in retarding direction. As a result, phase shift between the rotary support 3 and the timing sprocket 4 can be caused in advancing direction only in response to counterclockwise torque generated upon closure of the intake valve to cause relative phase shift in retarding direction. Magnitude of the phase shifting is limited by the stopper pin 13 abutting on the edge 14*a* of the opening 14. On the other hand, while the engine load is higher than the engine load criterion. The HIGH level control signal is supplied to the electromagnetic valve 25 to cause shifting of the valve position to establish fluid communication between the oil pump 24 and the pressure chambers 17*a* and 18*a* via the hydraulic circuit. Therefore, the plunger 19 is protruded to restriction rotation of the cylindrical member 15 in retarding direction. At the same time, since the plunger 20 is retracted into the cylinder 18 to permit rotation of the cylindrical member 16, relative phase shift between the smaller diameter section 19*b* and the axial end portion 12*b* of the timing sprocket 12 in retarding direction is restricted by the resilient force of the spring clutch 6. Therefore, relative phase shift between the rotary support 3 and the timing sprocket 4 is caused only in advancing direction in response to the clockwise rotational torque generated upon opening of the intake valve.

While the present invention has been discussed in terms of the preferred embodiment of the invention, the invention can be embodied in various ways. Therefore, the invention should be understood to include all possible embodiments and modifications which can be implemented without departing from the principle of the invention, which is set out in the appended claims.

What is claimed is:

1. A valve timing control device for an internal combustion engine, comprising:

an engine revolution synchronous rotary member which is drivingly connected to the internal combustion engine to be driven for rotation in synchronism with the engine revolution;

a camshaft associated with at least one of an intake and exhaust valves of an engine cylinder for driving associated intake and exhaust valves;

a camshaft synchronous rotary member connected to said camshaft for rotation in synchronism with rotation of said camshaft, said camshaft synchronous rotary member being coupled with said engine revolution synchronous rotary member to be rotatingly driven by rotational torque transmitted through said engine revolution synchronous rotary member with maintaining given rotational phase relationship to the latter;

a first and second spring clutch assemblies which are selectively engaged and disengaged for selectively permitting relative phase shift between said engine revolution synchronous rotary member and said camshaft synchronous rotary member in timing advancing and retarding timing in order to set said given rotational phase relationship.

2. A valve timing control device as set forth in claim 1, wherein each of aid first and second clutch assemblies comprises a spring clutch having first end connected to said engine revolution synchronous rotary member.

3. A valve timing control device as set forth in claim 2, wherein spring clutches in said first and second clutches having winding directions mutually opposite to each other.

4. A valve timing control device as set forth in claim 2, wherein said spring clutch has a second end connected to a rotary cylinder which is associated with stopper means selectively restricting and permitting rotation of said spring clutch for engaging and disengaging associated spring clutch.

5. A valve timing control device as set forth in claim 4, wherein said stopper means comprises a plunger housed within a plunger bore extending within said engine revolution synchronous rotary member, said plunger being operable between a first position restricting rotation of said rotary cylinder and a second position permitting rotation of said rotary cylinder.

* * * * *